United States Patent [19]

Bauder

[11] Patent Number: 5,021,707

[45] Date of Patent: Jun. 4, 1991

[54] COLOR PICTURE TUBE HAVING SHADOW MASK WITH IMPROVED SUPPORT

[75] Inventor: Richard C. Bauder, Lancaster, Pa.

[73] Assignee: RCA Licensing Corporation, Princeton, N.J.

[21] Appl. No.: 437,577

[22] Filed: Nov. 17, 1989

[51] Int. Cl.[5] ..... H01J 29/07

[52] U.S. Cl. ..... 313/402; 313/406; 313/404

[58] Field of Search ..... 313/402, 405, 404, 406, 313/407

[56] References Cited

U.S. PATENT DOCUMENTS

| | | | |
|---|---|---|---|
| 4,300,071 | 11/1981 | Dougherty et al. | 313/407 |
| 4,723,088 | 2/1988 | Sone et al. | 313/404 |
| 4,728,853 | 3/1988 | Sone et al. | 313/406 |
| 4,812,705 | 3/1989 | Wagenknecht et al. | 313/406 |
| 4,884,005 | 11/1989 | Kornaker et al. | 313/405 |
| 4,886,997 | 12/1989 | Inoue et al. | 313/407 |
| 4,963,786 | 10/1990 | Tokita et al. | 313/406 |

*Primary Examiner*—Palmer C. DeMeo

*Assistant Examiner*—John E. Giust

*Attorney, Agent, or Firm*—Joseph S. Tripoli; Dennis H. Irlbeck

[57] ABSTRACT

An improved color picture tube includes a rectangular faceplate panel having two long sides and two short sides. A rectangular shadow mask is suspended at its four corners by support means within the panel adjacent to a cathodoluminescent screen located on the panel. The tube has three principal axes that are mutually orthogonal to each other. These axes include a longitudinal axis which extends through the center of the tube perpendicularly to the center of the panel, a major axis which passes through the center of the panel paralleling the long sides of the panel, and a minor axis which passes through the center of the panel paralleling the short sides of the panel. Each of the support means has a central support axis. The improvement comprises the two support axes on each side of the minor axis crossing a plane containing the longitudinal and major axes at a point located between the minor axis and a short side of the panel.

2 Claims, 2 Drawing Sheets

COLOR PICTURE TUBE HAVING SHADOW MASK WITH IMPROVED SUPPORT

This invention relates to color picture tubes of the type having a shadow mask which is suspended in relation to a cathodoluminescent screen, and particularly to an improved corner support for such shadow mask that minimizes vibration misregister and provides better shock response.

BACKGROUND OF THE INVENTION

It is common to use either three or four springs to support a shadow mask within a rectangular faceplate panel of a color picture tube. In a three spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the shadow mask to slightly twist and shift relative to the faceplate during manufacturing and tube operation.

One means for minimizing twisting and shifting of a shadow-mask uses spring supports at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 1, 1988.

U.S. Pat. No. 4,723,088 shows a shadow mask frame having truncated corners with supports at each corner. The supports are bent plates including three sections. A first section is welded to the frame. A second section extends at an angle from the first section toward a skirt of a faceplate panel. A third section extends from the second section. The third section includes an aperture that engages a metal stud that is embedded in the panel sidewall.

U.S. Pat. No. 4,728,853 discloses an improved support which includes two members welded together. One member, having a flat plate shape, is welded to a mask frame. The second member includes three sections. A first section is welded to the first member. A second section angles from the first section, and an apertured third section engages a support stud in the panel sidewall.

FIG. 4 of U.S. Pat. No. 4,723,088 shows a mask-frame assembly having the support means aligned with the diagonals of the assembly. The embodiment shown has a 4 by 3 aspect ratio. When tubes having a 16 by 9 aspect ratio were recently developed, it was decided to utilize the corner support concept and to align the mask support means with the diagonals. However, tubes so constructed exhibited substantial electron beam misregister when they were subjected to vibration and/or shock. Such misregister also occurred in tubes having a 4 by 3 aspect ratio but to a lesser extent. Therefore, there is a need for an improved mask mounting system that will minimize vibration misregister and provide a better response to shock. Such improvement is especially needed in tubes having a 16 by 9 aspect ratio, but should also provide some improvement in tubes having a 4 by 3 aspect ratio.

SUMMARY OF THE INVENTION

An improved color picture tube includes a rectangular faceplate panel having two long sides and two short sides. A rectangular shadow mask is suspended at its four corners by support means within the panel, adjacent to a cathodoluminescent screen located on the panel. The tube has three principal axes that are mutually orthogonal to each other. These axes include a longitudinal axis which extends through the center of the tube perpendicularly to the center of the panel, a major axis which passes through the center of the panel paralleling the long sides of the panel, and a minor axis which passes through the center of the panel paralleling the short sides of the panel. Each of the support means has a central support axis. The improvement comprises the two support axes on each side of the minor axis crossing a plane containing the longitudinal and major axes at a point located between the minor axis and a short side of the panel.

DETAILED DESCRIPTION OF THE PREFERRED EMBODIMENT

Figure 1:
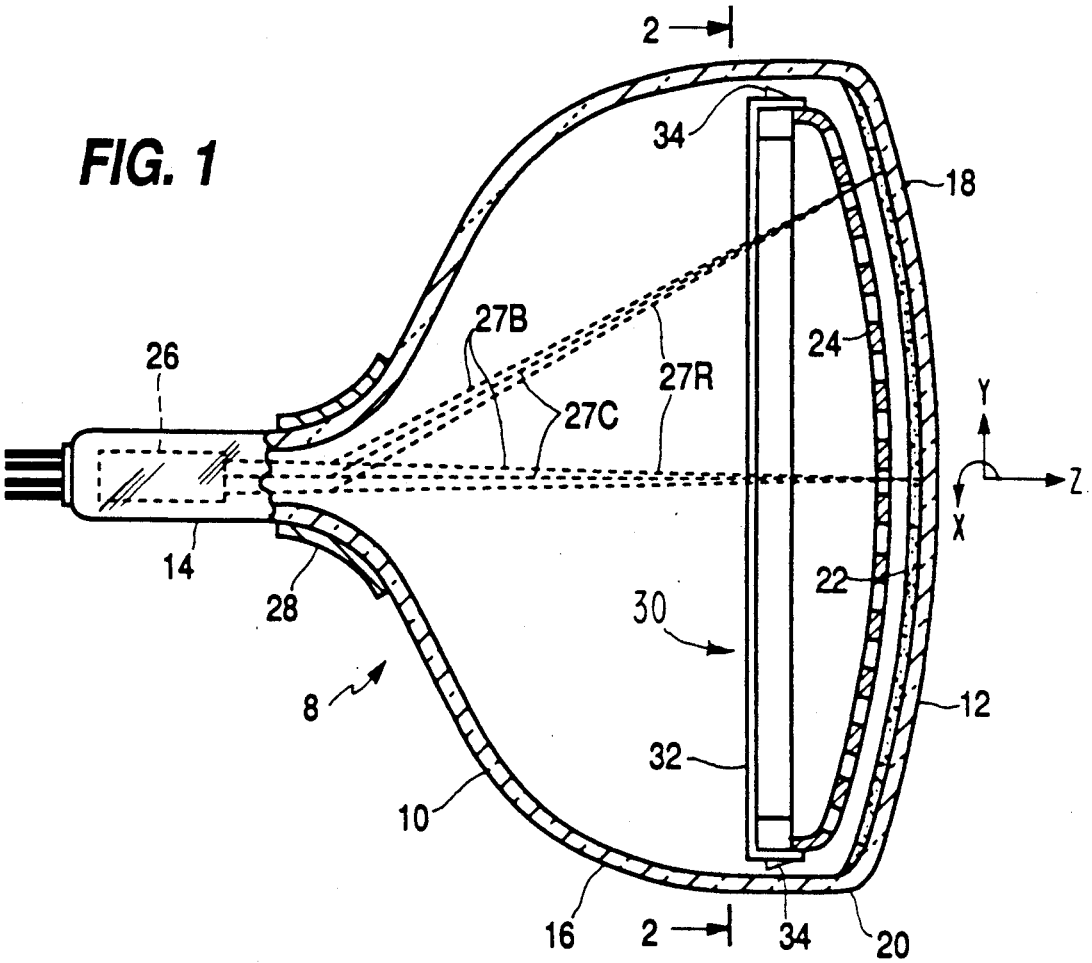
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and peripheral flange or sidewall 20 which is sealed to the funnel 16. The faceplate panel 12 has two long sides and two short sides and includes two orthogonal axes: a major axis X—X, parallel to the two long sides (usually horizontal), and a minor axis Y—Y, parallel to the two short sides (usually vertical). The major and minor axes are perpendicular to the central longitudinal axis Z—Z of the tube which passes through the center of the neck 14 and the center of the panel 12. A mosaic three-color phosphor screen 22 is carried by the inner surface of the faceplate 18. The screen preferably is a line screen, with the phosphor lines extending substantially parallel to the minor axis Y—Y, and has a 16 by 9 (horizontal by vertical) aspect ratio. Alternatively, the screen may be a dot screen. A multiapertured color selection electrode or shadow mask 24 is removably mounted, by novel means, in predetermined spaced relation to the screen 22. An electron gun 26 is centrally mounted within the neck 14, to generate and direct three electron beams 27B, 27G and 27R along convergent paths through the mask 24 to the screen 22.

The tube of FIG. 1 is designed to be used with an external magnetic deflection yoke, such as the yoke 28, located in the neighborhood of the funnel-to-neck junction. When activated, the yoke 28 subjects the three beams to magnetic fields which cause the beams to scan horizontally and vertically in a rectangular raster over the screen 22.

The shadow mask 24 is part of a mask-frame assembly 30 that also includes a peripheral frame 32. The mask-frame assembly 30 is shown positioned within the faceplate panel 12 in FIGS. 1, 2 and 5. The mask-frame assembly 30 is mounted to the panel 12 by four support means 34.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z—Z of the tube 8. The four corners of the frame 32 are truncated, being angled at an angle greater than the diagonal angle with respect to the major axis X—X. For a tube having a 16 by 9 aspect ratio, this diagonal angle is 29.358°. Preferably, the corners are angled in the range of about 33 degrees to about 50 degrees.

Figure 3:
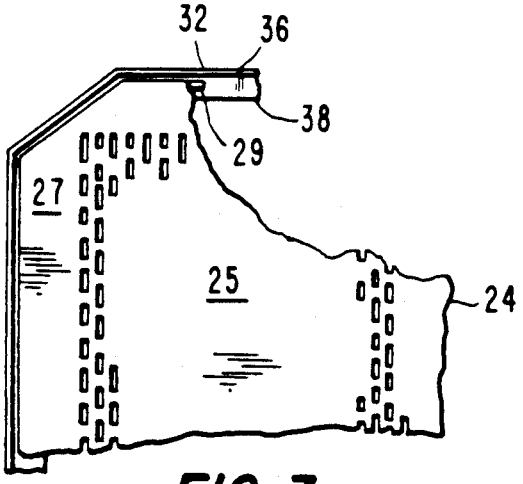
FIG. 3 is partial plan view of a corner of the shadow mask of the tube of FIG. 1.
Figure 4:
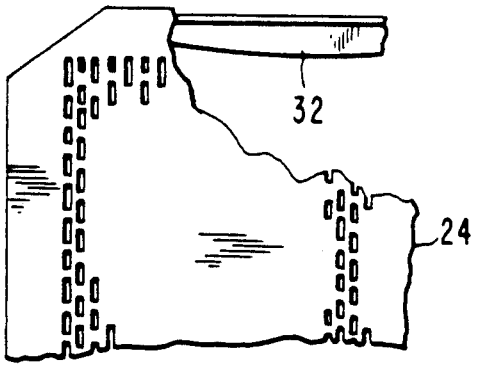
FIG. 4 is a partial plan view of a corner of an alternative shadow mask.
Figure 5:
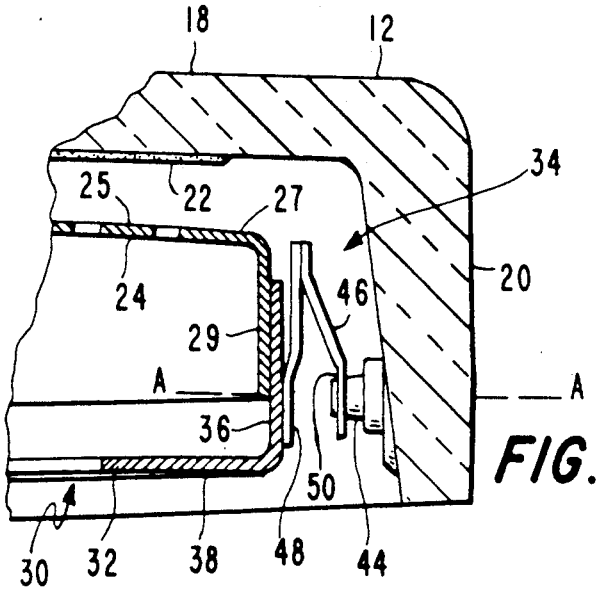
FIG. 5 is a partially sectioned view of a corner of the faceplate of FIG. 2.

The shadow mask 24, as shown in FIGS. 3 and 5 includes a curved apertured portion 25, an imperforate border portion 27 surrounding the apertured portion 25, and a skirt portion 29 bent back from the border position 27 and extending away from the screen 22. The mask 24 is telescoped within or set inside the frame 32 and is welded to the inside surface of the first flange 36. Alternatively, the mask 24 may be telescoped over or set outside the frame 32, as shown in FIG. 4.

Mask-frame assembly support means 34 are included at each of the four corners of the frame and panel. As shown in FIG. 5, each support means 34 includes a stud 44, a spring 46 and a plate 48. Each stud 44 is a conically-shaped metal member that is attached to or embedded into the panel sidewall 20. Each plate 48 is welded near one end to the flange 36, at a truncated corner of the frame 32 so that it extends toward the faceplate 18. The spring 46 is attached at one of its ends to the other end of the plate 48. An aperture 50, near the free end of each spring 46, engages the conical tip of the stud 44.

Figure 2:
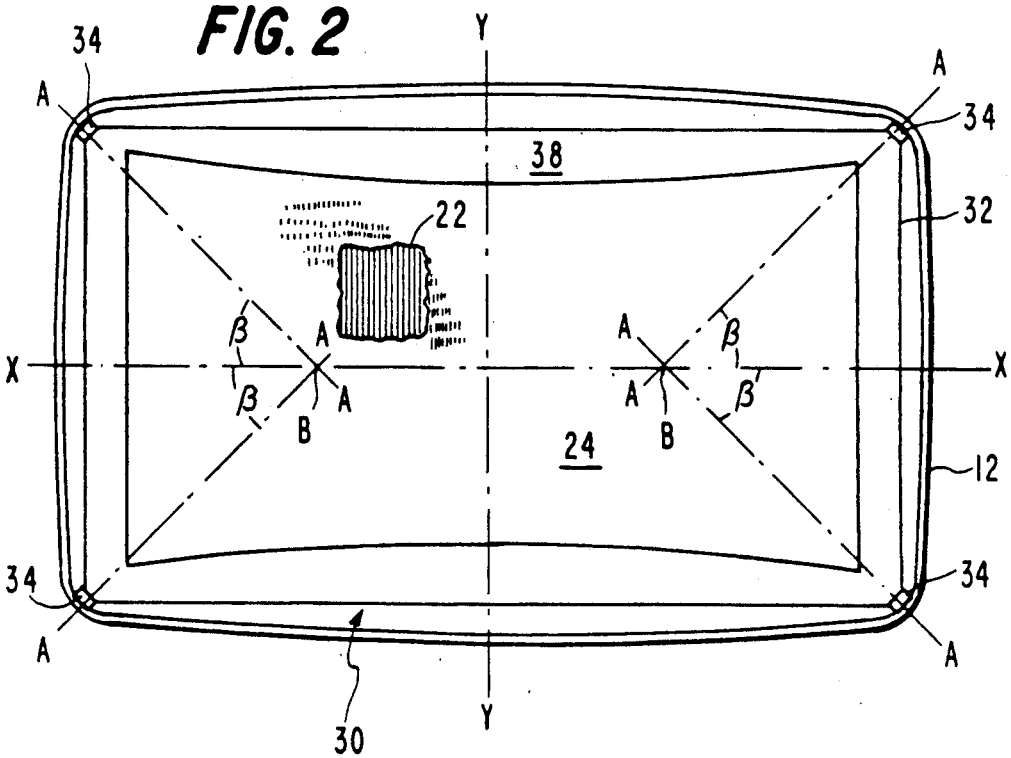
FIG. 2 is a back view of a faceplate panel and mask-frame assembly, partially cut away, taken at line 2—2 in FIG. 1.
Figure 6:
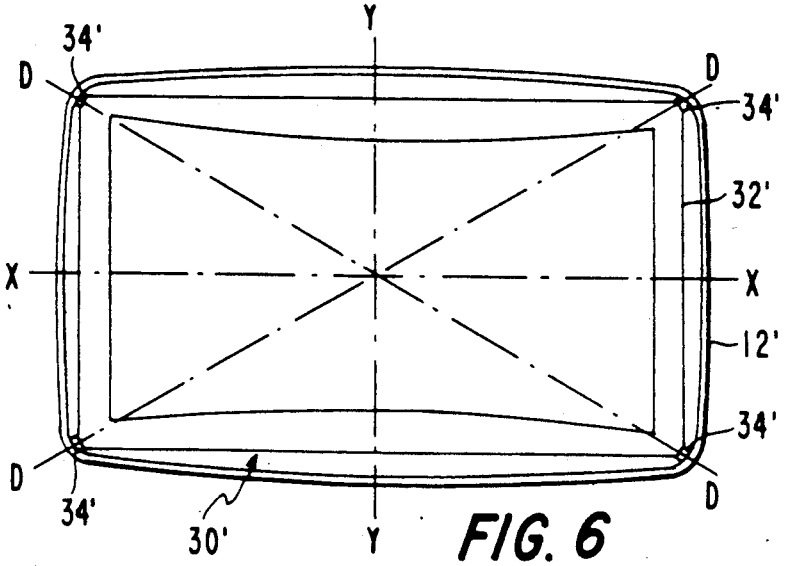
FIG. 6 PRIOR ART
FIG. 6 is a plan view of a prior art faceplate panel and mask-frame assembly.

A prior art faceplate panel 12' and mask-frame assembly 30' are shown in FIG. 6. Components that are similar to components in FIG. 2 are labelled with primes of the same number in FIG. 6. In this prior art embodiment, truncated corners of the frame 32' are perpendicular to the diagonals D—D, and the support means 34' are radially aligned with the diagonals D—D that pass through the coordinate center of the faceplate panel 12'. Although this radially aligned support system has proven adequate for tubes having 4 by 3 aspect ratios, it has created some problems in tubes having 16 by 9 aspect ratios. The principal difficulty with the radially aligned support system in 16 by 9 aspect ratio tubes is its inability to adequately survive shock and vibration environments. By increasing the angle of alignment that the support means 34 make with the major axis X—X, as shown in FIG. 2, the shock stress is significantly reduced, the motion of the mask-frame assembly along the direction of shock is reduced, and the vibration of the assembly is improved by increasing the resonant frequency and by reducing the associated displacement.

In FIGS. 2 and 5, the support means 34 at each corner of the tube includes a support axis A—A that corresponds with the central axis of each stud 44. Each support axis A—A is substantially perpendicular to a truncated corner of the frame 32. The two support axis A—A on each side of the minor axis Y—Y cross a plane that contains the longitudinal axis Z—Z and major axis X—X at a point B located between the minor axis Y—Y and a short side of the faceplate panel 12. Preferably, in a tube having a 16 by 9 aspect ratio, each support axis A—A forms an angle B of about 33 degrees to about 50 degrees with the major axis plane defined above.

A finite element analysis was made of two 34 V (34 inch viewable diagonal) tubes. With the exception of having different support means the two tubes were identical each having a 16 by 9 aspect ratio, a 0.25 mm thick steel mask, a 1.5 mm thick steel frame, a 1.0 mm thick steel support plate and a 0.5 mm thick stainless steel spring. The total weight of each mask-frame assembly was 3.54 kg (7.8 lbs). In the first tube, the support axes are aligned with the mask diagonal, each forming an approximate angle of 29.4 degrees with the major axis plane. In the second tube, each of the support axes was oriented at an angle B of 40 degrees with respect to the major axis plane. The results of the analysis are presented in Table I.

TABLE I

| | First Tube 29.4 Degree | Second Tube 40 Degree |
|---|---|---|
| Maximum Spring Stress (50G plus preload) | 2530 MPa | 1751 MPa |
| Lowest Resonant Frequency | 38 Hz | 60 Hz |
| Frame Motion in Panel (50G × Load) | 7.6 mm | 3.6 mm |
| Spring Deflection During Shock (50G × Load) | 5.6 mm | 2.7 mm |

As can be seen in Table I, the increase in angle of the support axes both raises the lowest resonant frequency and reduces motion of the mask-frame assembly within the faceplate panel.

What is claimed is:

1. In a color picture tube including a rectanglar faceplate panel having two long sides and two short sides, a rectangular shadow mask being suspended at its four corners by support means within said panel adjacent to a cathodoluminescent screen located on said panel, said tube having three principal axes that are mutually orthogonal to each other, said axes being a longitudinal axis which extends through the center of said tube perpendicularly to the center of said panel, a major axis which passes through the center of said panel paralleling the long sides of said panel, and a minor axis which passes through the center of said panel paralleling the short sides of said panel, each of said support means having a central support axis, the improvement comprising the two support axes on each side of said minor axis crossing a plane containing said longitudinal and major axes at a point located between the minor axis and a short side of said panel, said screen having an aspect ratio of approximately 16 by 9, and each of the support axes forming an angle of about 33 degrees to about 50 degrees with the plane containing said major and longitudinal axes.

2. The tube as defined in claim 1 wherein each of the support axes forms an angle of approximately 40 degrees with the plane containing said major and longitudinal axes.

* * * * *